US008011529B2

(12) United States Patent
Lien

(10) Patent No.: US 8,011,529 B2
(45) Date of Patent: Sep. 6, 2011

(54) MOUTH PIECE ASSEMBLY

(76) Inventor: Chien Ping Lien, Taipei Hsien (TW)

( * ) Notice: Subject to any disclaimer, the term of this patent is extended or adjusted under 35 U.S.C. 154(b) by 621 days.

(21) Appl. No.: 12/213,310

(22) Filed: Jun. 18, 2008

(65) Prior Publication Data

US 2009/0314789 A1 Dec. 24, 2009

(51) Int. Cl.
*A47G 19/22* (2006.01)

(52) U.S. Cl. ..... 220/714; 220/703

(58) Field of Classification Search ..... 220/707–709, 220/714, 703, 728, 711; 222/175, 536; 251/342; 215/387, 388, 229; 224/148
See application file for complete search history.

(56) References Cited

U.S. PATENT DOCUMENTS 4,485,963 A * 12/1984 Panicci ..... 229/103.1
5,203,468 A * 4/1993 Hsu ..... 220/254.3
5,582,320 A * 12/1996 Lin ..... 220/708
6,279,773 B1 * 8/2001 Kiyota ..... 220/709
6,390,341 B1 * 5/2002 Ohmi et al. ..... 222/536
6,994,269 B2 * 2/2006 Lien ..... 239/24
6,997,441 B2 * 2/2006 Yang ..... 251/353
7,093,735 B2 * 8/2006 Stephens ..... 220/705
7,140,509 B2 * 11/2006 Yang ..... 220/709
7,533,783 B2 * 5/2009 Choi et al. ..... 220/714
2005/0040175 A1 * 2/2005 Stephens ..... 220/705
2009/0167018 A1 * 7/2009 Lien ..... 285/308

* cited by examiner

*Primary Examiner* — J. Gregory Pickett
*Assistant Examiner* — Andrew Perreault
(74) *Attorney, Agent, or Firm* — Bacon & Thomas, PLLC

(57) ABSTRACT

A mouth piece assembly includes a mouth piece unit having a pivot which is pivotably connected to a first connector so that the mouth piece unit is pivotable about an axis of the pivot relative to the first connector. The first connector is pivotably inserted into a second connector so that the first connector is pivotable about an axis of the second connector. The two respective axes are perpendicular to each other. A locking key is connected to the second connector and engaged with the first connector inserted into the second connector. The mouth piece unit can be pivoted in two different directions and the volume of liquid sucked from the container is not changed.

4 Claims, 9 Drawing Sheets

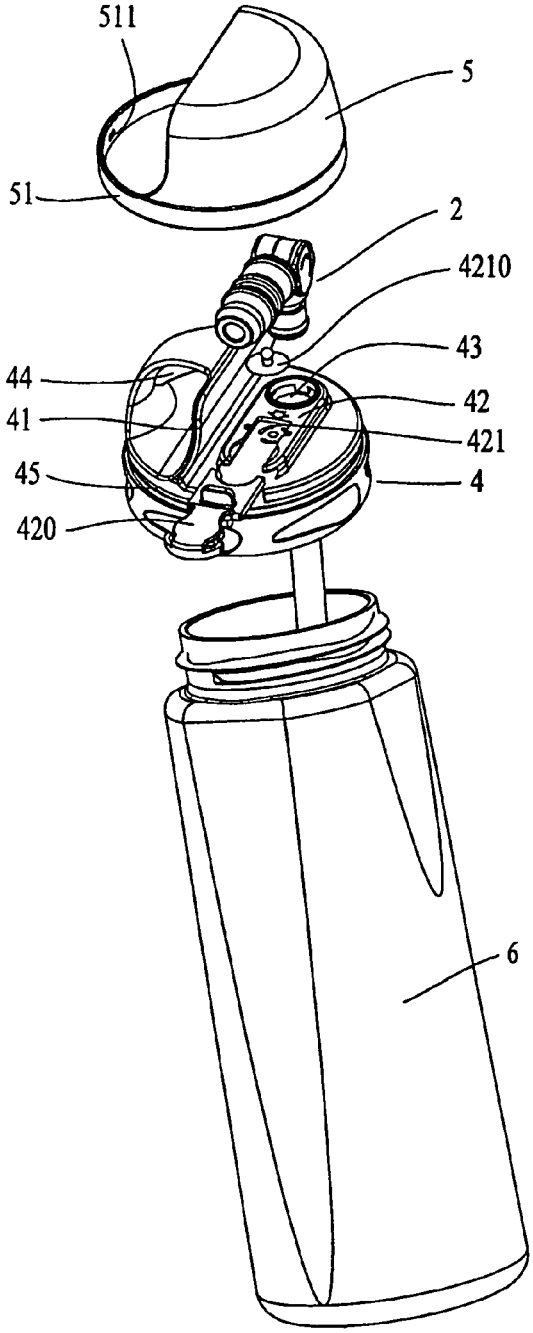
FIG.7
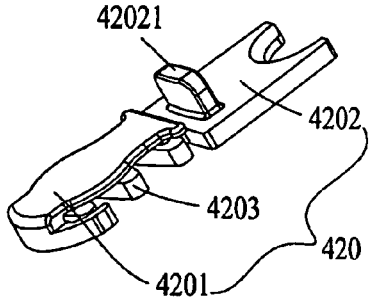
FIG.7-A

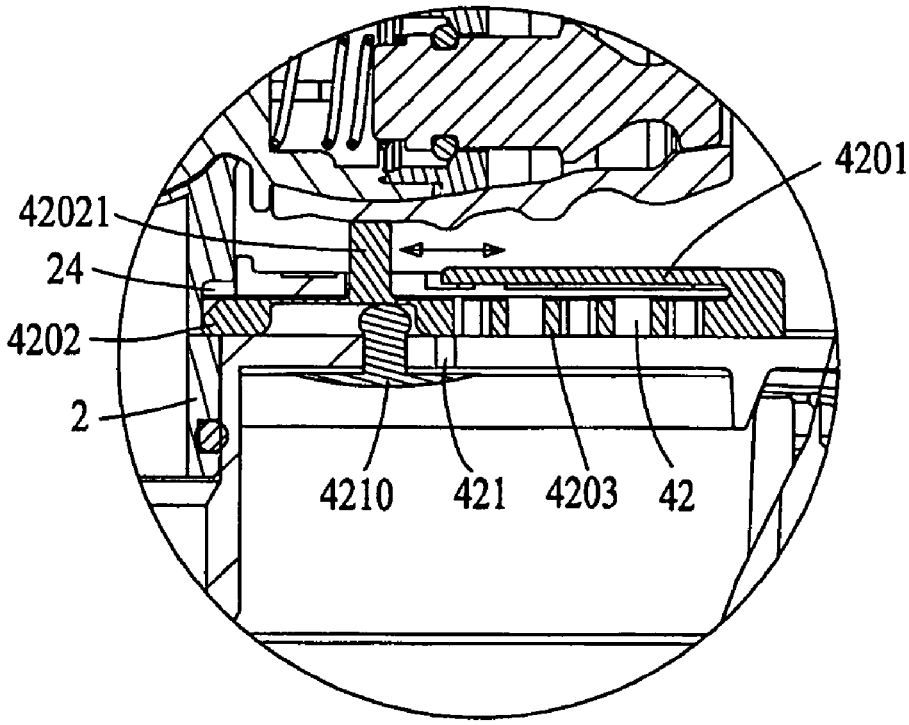
FIG.9-A

MOUTH PIECE ASSEMBLY

FIELD OF THE INVENTION

The present invention relates to a rotatable mouth piece assembly which can be pivoted in tow different directions while the volume of liquid is not affected.

BACKGROUND OF THE INVENTION

A conventional mouth piece assembly for container known to applicant discloses a mouth piece assembly that is pivotable relative to the container such that the user can suck the liquid in the container at different angular positions. The disclosure includes an elbow-shaped member which is connected between a valve and a pipe into the container. The valve is connected with the mouth piece and has a stop flange which is cooperated with a seal member which seals the outlet of the container. The valve includes an inlet which in communication with the mouth piece when the elbow shaped member is rotated to a position, such that the user can suck the liquid in the container. The mouth piece is isolated from the valve when the elbow-shaped member is rotated to another position. However, the maximum volume for the user to suck the liquid in the container is only happened when the mouth piece is rotated to the 90-degree position and the volume is reduced along with the angle that the mouth piece is rotated. In other words, the mouth piece assembly simply is a switch to seal the communication of the pipe into the container by rotating the mouth piece.

The present invention intends to provide a mouth piece assembly which provides sufficient and constant volume of liquid that can be sucked from the container via the mouth piece assembly regardless of position of the mouth piece.

SUMMARY OF THE INVENTION

The present invention relates to a mouth piece assembly which comprises a mouth piece unit having a pivot at a first end thereof and a hollow tube extends perpendicularly from the pivot. The pivot is pivotably inserted into an insertion slot defined axially in a first end of a first connector which has a passage defined axially therein. A central hole is defined through one of two parts separated by the insertion slot and communicates with the insertion slot. The hollow tube is inserted into the central hole. A second end of the first connector is inserted into a body at a first end of a second connector. An engaging slot is defined in an outside of the body and a locking key is removably engaged with the engaging slot. The locking key is engaged with a first groove defined in the second end of the first connector.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 7 is an exploded view to show the mouth piece assembly of the present invention is cooperated with a container;

FIG. 7A shows the locking member of the mouth piece assembly of the present invention;

FIG. 9A is an enlarged view to show the structure in the circle E in FIG. 9.

DETAILED DESCRIPTION OF THE PREFERRED EMBODIMENT

Figure 1:
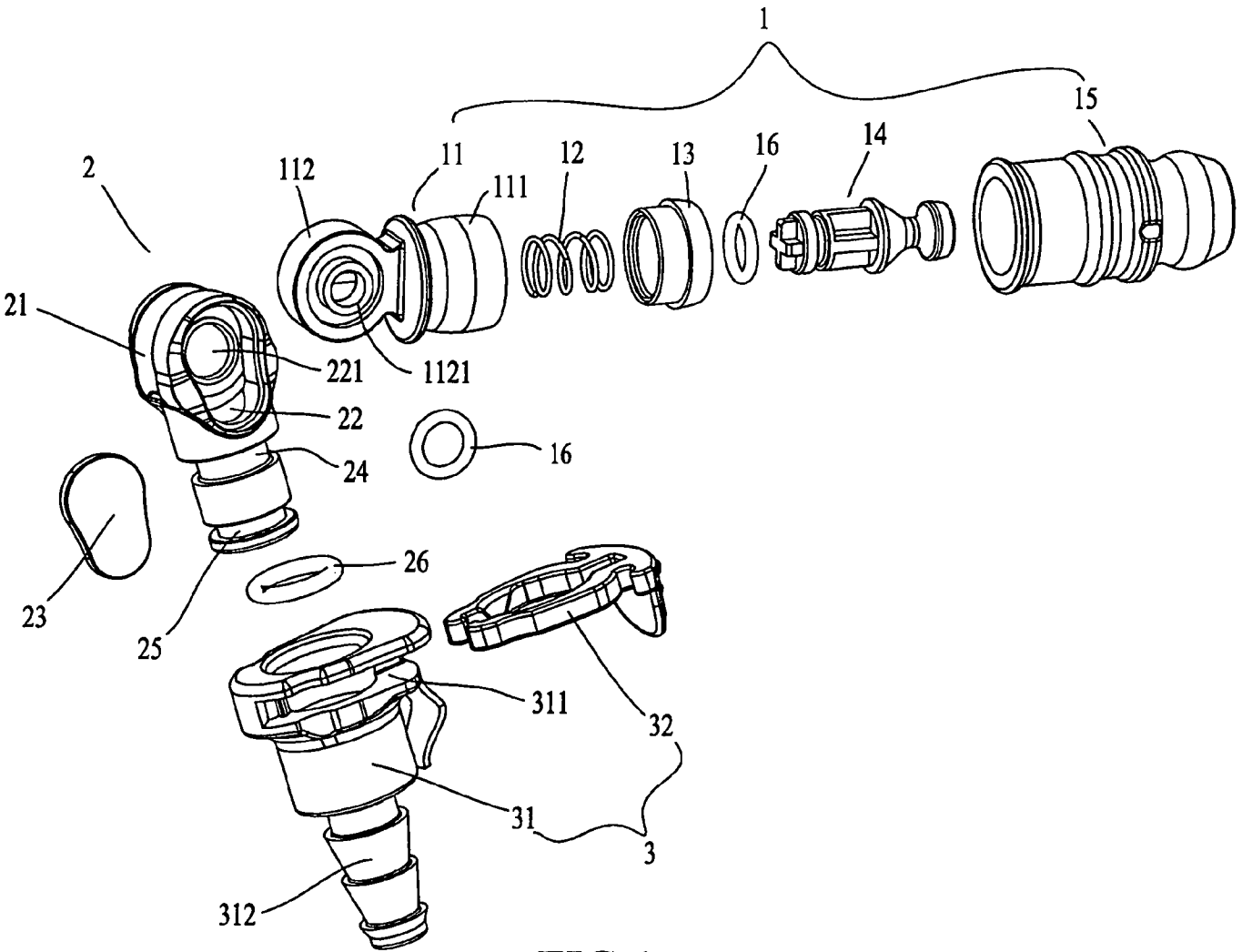
FIG. 1 is an exploded view to show the mouth piece assembly of the present invention.
Figure 2:
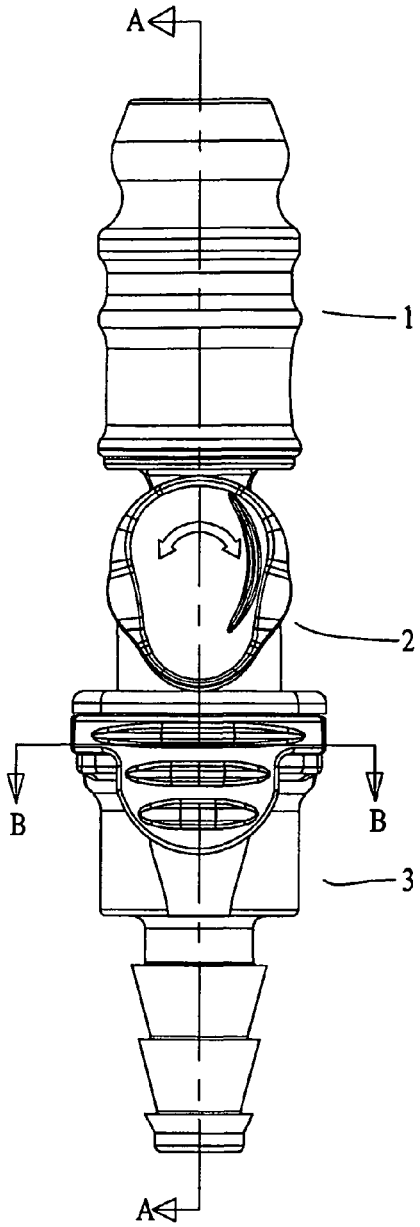
FIG. 2 is a side view of the mouth piece assembly of the present invention.
Figure 3:
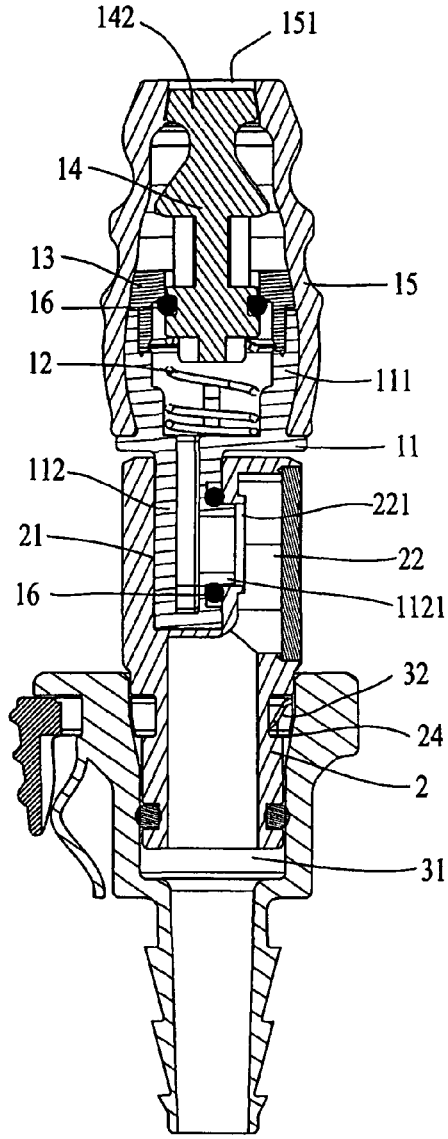
FIG. 3 is a cross sectional view along line A-A in FIG. 2.
Figure 4:
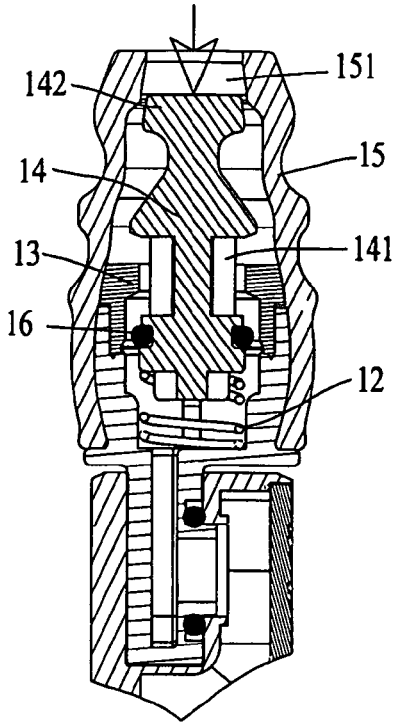
FIG. 4 shows the outlet is opened when the seal member is moved downward.

Referring to FIGS. 1 to 3, the mouth piece assembly of the present invention comprises a mouth piece unit 1, a first connector 2 and a second connector 3. The mouth piece unit 1 has a pivot 112 connected to a first end thereof and a hollow tube 1121 extends perpendicularly from the pivot 112. The hollow tube 1211 communicates with the pivot 112. A seal ring 16 is mounted to the hollow tube 1121. A connection end 111 extends from the first end of the body 11 and a mouth piece 15 is connected to the connection end 111. A spring 12 is received in the body 11 and has an end contacting against a seal member 14 in the connection end 111. A seal ring 16 is mounted to a first end of the seal member 14 which includes a plurality of ribs 141 extending radially therefrom. A seal end 142 is connected to a second end of the seal member 14 so as to removably seal the outlet 151 of the mouth piece 15 as shown in FIG. 4. A collar 13 is received in the insertion end 111 and the first end of the seal member 14 is engaged with the collar 13.

The first connector 2 has an insertion slot 21 defined axially in a first end thereof and a passage 22 is defined axially in the first connector 2 and communicates with the insertion slot 21. A central hole 221 is defined through one of two parts separated by the insertion slot 21 and communicates with the insertion slot 21 and the passage 22. Further referring to FIG. 6, the pivot 112 is inserted into the insertion slot 21 and the hollow tube 1121 is inserted into the central hole 221, so that the mouth piece unit 1 is rotatable about an axis of the hollow tube 1121. A cover 23 is engaged with the part having the central hole 221. A second end of the first connector 2 has a first groove 24 and a second groove 25 defined in an outside thereof, a seal ring 26 engaged with the second groove 25.

Figure 5:
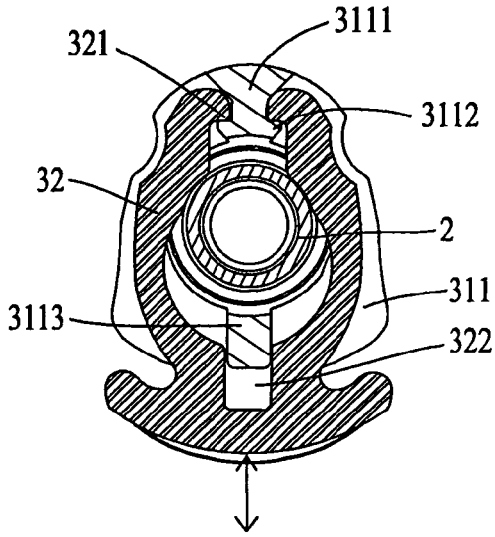
FIG. 5 is a cross sectional view along line B-B in FIG. 2.
Figure 6:
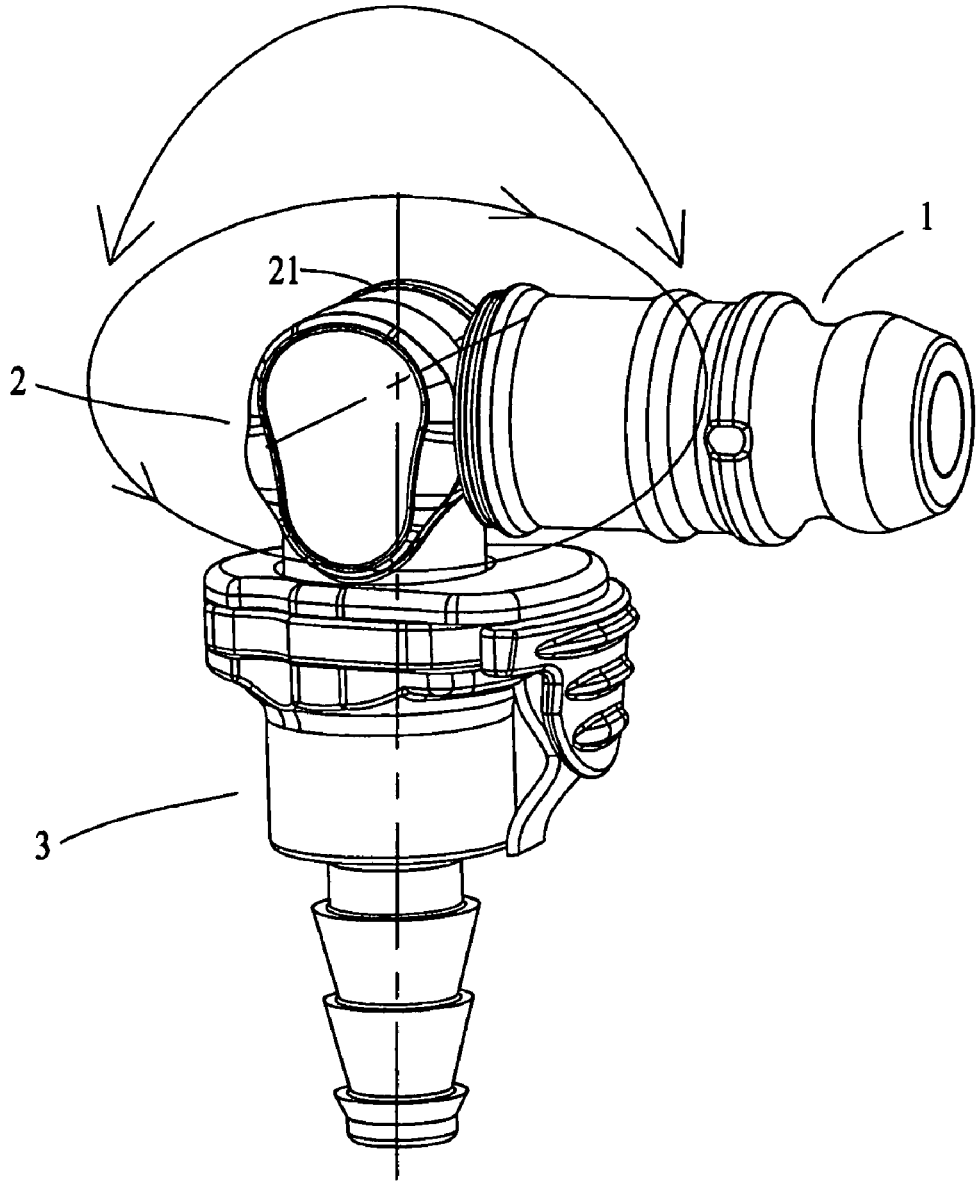
FIG. 6 shows that the mouth piece unit is pivoted about two different axes.
Figure 8:
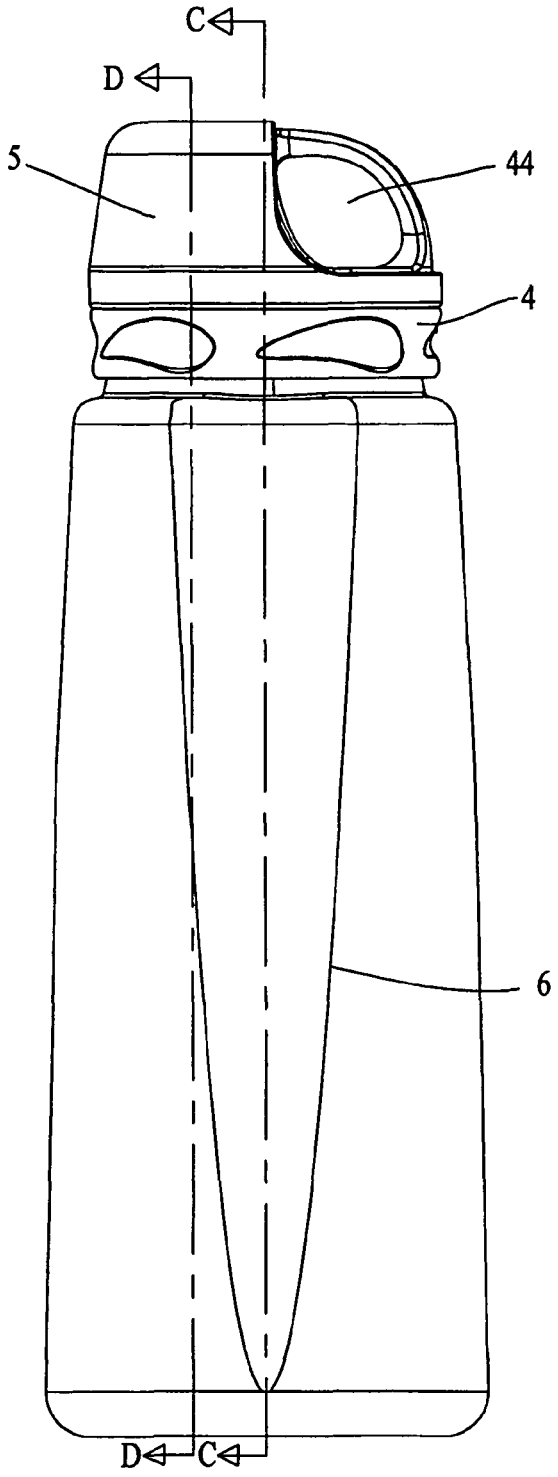
FIG. 8 is a plane view to show the mouth piece assembly of the present invention is connected with a container.
Figure 9:
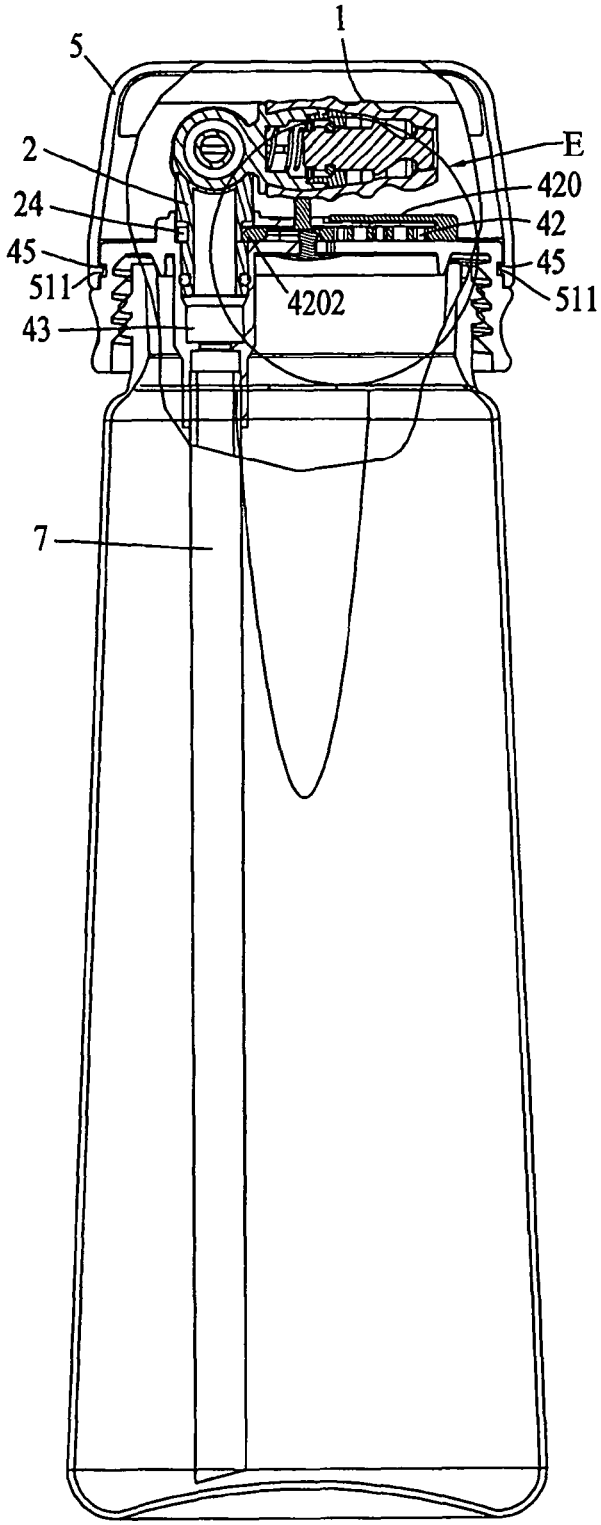
FIG. 9 is a cross sectional view along lines C-C and D-D in FIG. 8.

The second connector 3 has a body 31 at a first end thereof and an engaging slot 311 is defined in an outside of the body 31. A C-shaped locking key 32 is removably engaged with the engaging slot 311. The second end of the first connector 2 is inserted into the body 31 and the locking key 32 is engaged with the first groove 24. As shown in FIG. 5, an end wall 3111 is located in the engaging slot 311 and an engaging portion 3112 extends from the end wall 3111. A guide rib 3113 is located in the engaging slot 311 and located opposite to the engaging portion 3112. The locking key 32 has two hook portions 321 on one end thereof and a guide slot 322 is defined in an inside of the other end of the locking key 32. The hook portions 321 are engaged with the engaging portion 3112 and stopped by the end wall 3111. The guide rib 3113 is movably engaged with the guide slot 322. By the locking key 32, the first and second connectors 2, 3 are connected to each other. The first connector 2 is pivotable about a longitudinal axis of the second connector 3 as shown in FIG. 6. The two respective axes are perpendicular to each other. A connection tube 312 is connected to the second end of the second connector 3.

FIGS. 7, 7A, 8, 9 and 9A show that the mouth piece assembly is connected with a container 6, wherein the second connector 3 is connected to a cap 4 which is threadedly connected to the opening of the container 6. The cap 4 includes a separation board 41 on a top thereof and an engaging slot 42 is defined in the cap 4 and located on one side of the separation board 41. A locking member 420 is engaged with the engaging slot 42. The locking member 420 has an extension plate 4201 extending from one end thereof and a locking plate 4202 is connected to the other end of the locking member 420. A spring plate 4203 is located between the extension plate 4201 and the locking plate 4202. A protrusion 42021 extends from the locking plate 4202. The engaging slot 42 has multiple air inlets 421 defined in an inner surface thereof and an air valve 4210 is cooperated with the air inlets 421. A hole 43 is defined in an end of the engaging slot 42 and through the cap 4. The second connector 3 is engaged with the hole 43 and a pipe 7 is connected with the hole 43. A finger hole 44 is located on the other side of the separation board 41. An annular third groove 45 is defined in an outside of the cap 4. A dust hat 5 is mounted to the cap 4 and includes a ring portion 51. A boss 511 extends from an inside of the ring portion 51 and engaged with the third groove 45.

As shown in FIG. 9A, when sucking the liquid from the container 6, the air outside enters in the container 6 via the air inlets 421 to keep a pressure balance in the container 6. When the container 6 is put up-side-down, the air valve 4210 seals the air inlets 421 to avoid from leakage. The extension plate 4201 is engaged with the engaging slot 42, thanks to the spring plate 4203, after the first connector 2 is connected to the cap 4, the locking plate 4202 is engaged with the first groove 24 of the first connector 2. When pulling the protrusion 42021, the locking plate 4202 is disengaged from the first groove 24 of the first connector 2, the first connector 2 can be dismounted from the cap 4.

Figure 10:
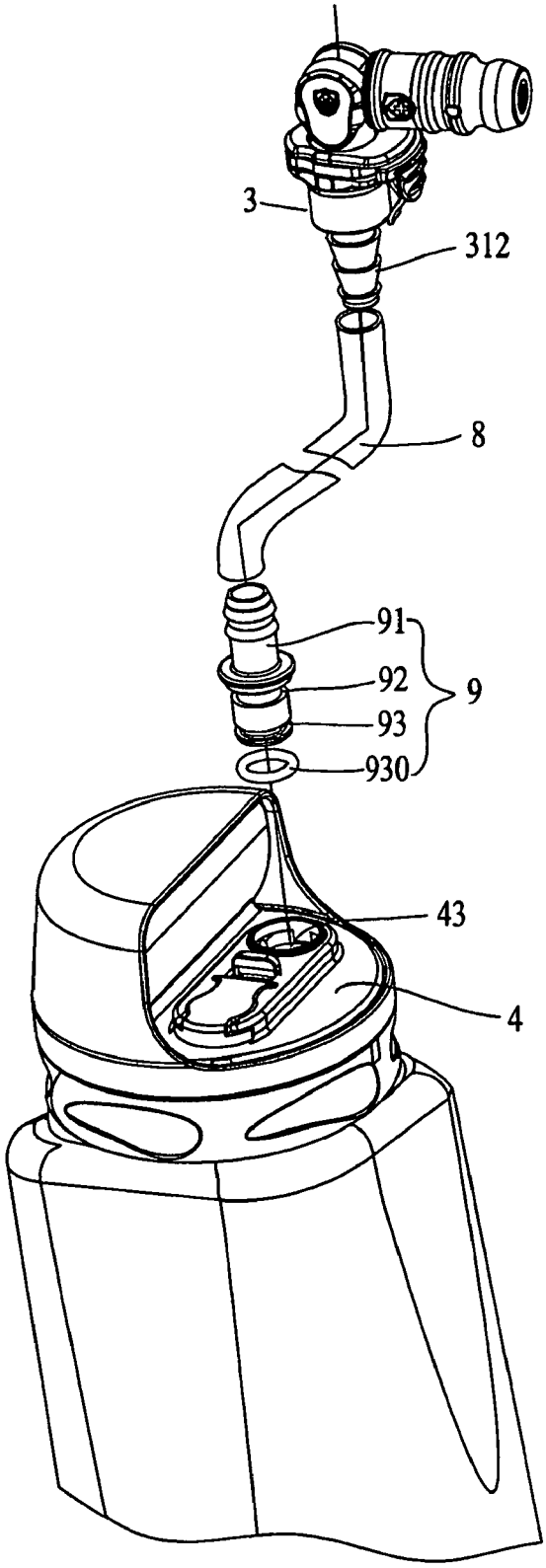
FIG. 10 shows that the mouth piece assembly of the present invention is connected to a container by an extension pipe.

As shown in FIG. 10, the mouth piece assembly can be cooperated with a extension pipe 8 to be connected with the container 6. A male connector 9 is connected to the second connector 3 on the cap 4 and has a connection tube 91 extending from a first end thereof. A fourth groove 92 is defined in a mediate portion of the male connector 9 and a fifth groove 93 is defined in an outside of a second end of the male connector 9. A seal ring 930 is engaged with the fifth groove 93. The second end of the male connector 9 is inserted in the hole 43 in the cap 4. An extension pipe 8 has one end connected to the connection tube 91 and the other end of the extension pipe 8 is connected to the connection tube 312 of the second connector 3. When the mouth piece unit 1 extends through the ring portion 51, the user can suck liquid in the container 6, after use, by rotating the dust hat 5, the boss 511 is moved in the third groove 45, the mouth piece unit 1 can be guided to be hidden by the dust hat 5.

While we have shown and described the embodiment in accordance with the present invention, it should be clear to those skilled in the art that further embodiments may be made without departing from the scope of the present invention.

What is claimed is:

1. A mouth piece assembly comprising:

a mouth piece unit having a pivot connected to a first end thereof and a hollow tube extending perpendicularly from the pivot, the hollow tube communicating with the pivot, a seal ring mounted to the hollow tube;

a first connector having an insertion slot defined axially in a first end thereof and a passage defined axially in the first connector and communicating with the insertion slot, a central hole defined through one of two parts separated by the insertion slot and communicating with the insertion slot, the pivot inserted into the insertion slot and the hollow tube inserted into the central hole, a second end of the first connector having a first groove and a second groove defined in an outside thereof, a seal ring engaged with the second groove, and a second connector having a body at a first end thereof and an engaging slot defined in an outside of the body, a locking key removably engaged with the engaging slot, the second end of the first connector inserted into the body and the locking key engaged with the first groove, wherein an end wall is located in the engaging slot and an engaging portion extends from the end wall, a guide rib is located in the engaging slot and located opposite to the engaging portion, the locking key is a C-shaped member and has two hook portions on one end thereof and a guide slot is defined in an inside of the other end of the locking key, the hook portions are engaged with the engaging portion and stopped by the end wall, the guide rib is movably engaged with the guide slot, and a connection tube is connected to the second end of the second connector, and wherein the second connector is connected to a cap which has a separation board on a top thereof, an engaging slot is defined in the cap and a locking member is engaged with the engaging slot, the locking member has an extension plate extending from one end thereof and a locking plate is connected to the other end of the locking member, a spring plate is located between the extension plate and the locking plate, a protrusion extends from the locking plate, the engaging slot has multiple air inlets defined in an inner surface thereof and an air valve is cooperated with the air inlets, a hole is defined in an end of the engaging slot and through the cap, the second connector is engaged with the hole and a pipe is connected with the hole, the engaging slot is located on one side of the separation board and a finger hole is defined in the other side of the separation board.

2. The assembly as claimed in claim 1, wherein a connection end extends from a first end of a body of the pivot and a mouth piece is connected to the connection end, a spring is received in the body of the pivot and has an end contacting against a seal member in the connection end, a seal ring is mounted to a first end of the seal member which includes a plurality of ribs extending radially therefrom, a seal end is connected to a second end of the seal member, a collar is received in the insertion end and the first end of the seal member is engaged with the collar, the seal end removably seals an outlet of the mouth piece.

3. The assembly as claimed in claim 1, wherein an annular third groove is defined in an outside of the cap, a dust cap is mounted to the cap and includes a ring portion, a boss extends from an inside of the ring portion and engaged with the third groove.

4. The assembly as claimed in claim 1, wherein a male connector is connected to the second connector on the cap and has a connection tube extending from a first end thereof, a fourth groove is defined in an mediate portion of the male connector and a fifth groove is defined in an outside of a second end of the male connector, a seal ring is engaged with the fifth groove, the second end of the male connector is inserted in the hole in the cap, an extension pipe has one end connected to the connection tube and the other end of the extension pipe is connected to the connection tube of the second connector.

* * * * *